United States Patent [19]

Sunada

[11] Patent Number: 4,506,581

[45] Date of Patent: Mar. 26, 1985

[54] TOUCH RESPONSE APPARATUS FOR ELECTRONIC KEYBOARD MUSICAL INSTRUMENT

[75] Inventor: Takuya Sunada, Fussa, Japan

[73] Assignee: Casio Computer Co., Ltd., Tokyo, Japan

[21] Appl. No.: 504,234

[22] Filed: Jun. 14, 1983

[30] Foreign Application Priority Data

Jun. 19, 1982 [JP] Japan ..... 57-105776
Dec. 8, 1982 [JP] Japan ..... 57-215179

[51] Int. Cl.[3] ..... G10H 1/02; G10H 1/34

[52] U.S. Cl. ..... 84/1.1; 84/1.26; 84/DIG. 7

[58] Field of Search ..... 84/1.1, 1.13, 1.26, 84/1.27, DIG. 7

[56] References Cited

U.S. PATENT DOCUMENTS 4,402,247 9/1983 Bione ..... 84/1.26

*Primary Examiner*—Stanley J. Witkowski

*Attorney, Agent, or Firm*—Frishauf, Holtz, Goodman & Woodward

[57] ABSTRACT

The present invention provides a touch response apparatus for an electronic keyboard instrument wherein, in controlling a touch response state by detecting a key depression speed in the electronic keyboard instrument, the touch response states of keys are detected by detection means smaller in number than the keys, and the difference of detection outputs attributed to the different mounting positions of the contacts of a white key and a black key is also compensated.

14 Claims, 8 Drawing Figures

TOUCH RESPONSE APPARATUS FOR ELECTRONIC KEYBOARD MUSICAL INSTRUMENT

BACKGROUND OF THE INVENTION

1. Field of the Invention

The present invention relates to a touch response apparatus for an electronic musical instrument. More particularly, it relates to a touch response apparatus for an electronic keyboard instrument wherein capacitors and resistors are used as a key touch detector circuit, a touch response function is effected by such key touch detector circuits smaller in number than keys, and the difference in touch response which is created by the difference between the mounting positions of the contacts of a black key and a white key is compensated.

2. Description of the Prior Art

In conventional electronic musical instruments, in order to effectively express the initial control of a musical sound by a key operation, it is common practice to control the performance sound upon detecting a key depression speed at the key operation.

In an apparatus furnished with such touch response function in which the volume, the tone color etc. of a musical sound to be generated are controlled by detecting the key depression speed, a plurality of key depression speed detecting means are required for controlling the volume and tone color of the musical sound to-be-generated in correspondence with the key depression speed besides an ordinary key-on signal.

Various functions for producing such key depression speed detecting signal have been proposed.

FIG. 1 is a sketch diagram of a key portion for explaining a prior-art key depression detecting means. Referring to the figure, a white key WK and a black key BK are respectively cantilevered at supporting points $X_1$ and $X_2$. When contacts $RC_1$, $RC_2$ or $RC_3$, $RC_4$ of conductive rubber or the like which are mounted on the lower surface of the white key or black key and which have lengths unequal to each other are depressed, the contact pieces of switches $SW_1$, $SW_2$ or $SW_3$, $SW_4$ fall into "on" states. Thus, key depression speed detecting means DET detects the speed signal of the white or black key corresponding to the speed of depression in the direction of arrow A or B, by using the time period from the closing of the switches $SW_1$ or $SW_3$ to the closing of the switches $SW_2$ or $SW_4$, respectively.

More specifically, when the white key WK is depressed in the direction A, it turns counterclockwise about the fulcrum $X_1$. Therefore, the contact $RC_1$ first comes into contact with the switch $SW_1$, and the contact $RC_2$ comes into contact with the switch $SW_2$ somewhat later. Likewise, when the black key BK is depressed in the direction B, the contact $RC_3$ comes into contact with the switch $SW_3$, whereupon the contact $RC_4$ comes into contact with the switch $SW_4$. A key depression speed can accordingly be obtained by measuring the period of time between the preceding contact and the succeeding contact, for example by using the charging or discharging amounts of capacitors provided in the key depression speed detecting means DET.

As a first key depression detecting means in the prior art, the key depression speed detecting means DET is disposed for each key. It includes a capacitor and a resistor. The key depression speed detection signal is detected as the amount of the charge of the capacitor by the aforementioned switches corresponding to the respective keys on the basis of the charging to the capacitor or the discharging to the resistor.

With such arrangement, the key depression speed detecting means DET must be disposed for each key, resulting in the disadvantage that the number of constituent parts increases.

Known as a second key depression detecting means is a digital arrangement wherein the period of time from the starting of key depression to the end thereof, that is, the period of time from the turn-on of the first or third switch $SW_1$ or $SW_3$ to the turn-on of the second or fourth switch $SW_2$ or $SW_4$ in the case of FIG. 1, is counted by a counter circuit or the like, and the count data is used as the key depression speed detection signal. Also this measure has the disadvantage that the counter circuits must be disposed for the respective keys. Another disadvantage is that the conversion of input data is necessary or that the external control is difficult.

Furthermore, according to the setup shown in FIG. 1, both the white and black keys must be provided with the contacts $RC_1$, $RC_3$ and the contacts $RC_2$, $RC_4$ at equal distance $l_1$ and $l_2$ from the fulcra $X_1$, $X_2$. It is extremely difficult and complicated to dispose such contacts $RC_1$ and $RC_3$, or $RC_2$ and $RC_4$ at the positions of the equal distances for a plurality of white and black keys. As another disadvantage, the touch response state of the black key or the structure of the keys becomes very unnatural.

BRIEF SUMMARY OF THE INVENTION

The present invention has been made in view of the disadvantages mentioned above.

A first object of the present invention is to provide a touch response apparatus for an electronic musical instrument which can afford touch responses without disposing key depression speed detecting means for respective keys, or with key depression speed detecting means smaller in number than the keys.

Another object of the present invention is to provide a touch response apparatus for an electronic keyboard instrument in which, when key depression detecting means for a white key and a black key are disposed in different positions so as to fabricate a natural mechanism, the compensation of the mounting positions is realized by electric circuit means.

Still another object of the present invention is to provide a touch response apparatus for an electronic keyboard instrument which is easy of external control.

Yet another object of the present invention is to provide a touch response apparatus for an electronic keyboard instrument which need not arrange the key depression detecting means of a white key and a black key at equal distances from the cantilever fulcra of the white and black keys.

The other objects, features and advantages of the present invention will become apparent from the following description taken in conjunction with the accompanying drawings through which the like references designate the same elements and parts.

BRIEF DESCRIPTION OF THE DRAWINGS

FIG. 4A is a circuit diagram of a touch control data generator unit shown in FIG. 3, while

DETAILED DESCRIPTION OF THE INVENTION

Now, the details of the present invention will be described with reference to FIGS. 2 to 7.

Figure 2:
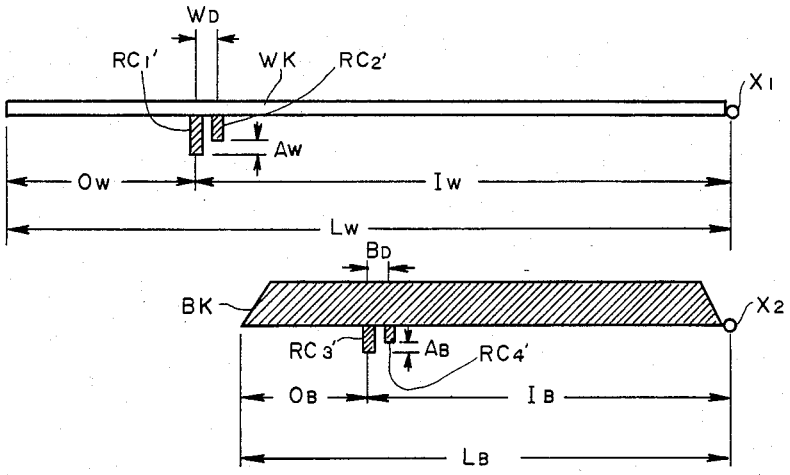
FIG. 2 is a side view of keys as the model of a keyboard mechanism, showing an embodiment of a touch response apparatus for an electronic keyboard instrument according to the present invention.

FIG. 2 shows the relationship between a white key and a black key for use in the present invention and the mounting positions of contacts, which will be discussed in detail hereinbelow.

A white key WK and a black key BK are cantilevered at supporting points $X_1$ and $X_2$, respectively. Their lengths are denoted by $L_W$ (for example, 12 cm) and $L_B$ (for example, 8 cm), respectively. The white key WK is provided with contacts $RC_1'$ and $RC_2'$. The distance from the fulcrum $X_1$ to the contact $RC_1'$ is denoted by $I_W$, and the distance from the contact $RC_1'$ to the free end of the key WK is denoted by $O_W$. It is assumed by way of example that the ratio between the distances $I_W$ and $O_W$ is 3:1. Similarly, the black key BK is provided with contacts $RC_3'$ and $RC_4'$. The distance from the fulcrum $X_2$ to the contact $RC_3'$ is denoted by $I_B$, while the distance from the contact $RC_3'$ to the free end of this key BK is denoted by $O_B$. The contact $RC_3'$ of the black key BK is disposed at the same ratio of the distances as in the white key WK, whereby the distances $I_B$ and $O_B$ come to have the ratio of 3:1.

In addition, the distance $W_D$ between the contacts $RC_1'$ and $RC_2'$ of the white key and that $B_D$ between the contacts $RC_3'$ and $RC_4'$ of the black key are selected at $W_D:B_D=3:2$.

Further, the difference $A_W$ of the heights of the contacts $RC_1'$ and $RC_2'$ in the white key WK and that $A_B$ of the heights of the contacts $RC_3'$ and $RC_4'$ in the black key BK are set at a ratio of $A_W:A_B=3:2$ likewise to the proportion of the full lengths $L_W$ and $L_B$ of the white and black keys.

Figure 1:
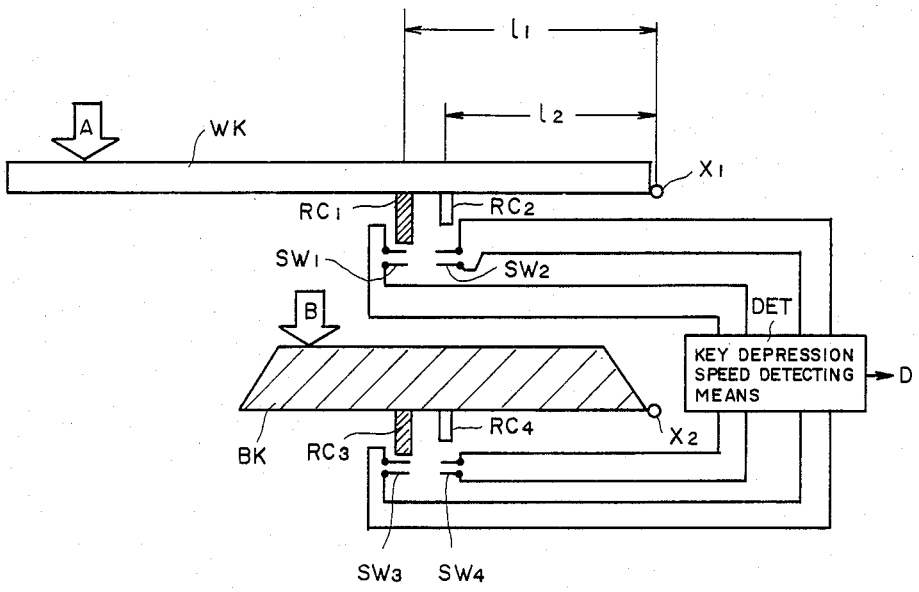
Fig. 1 PRIOR ART
FIG. 1 is a schematic side view for explaining the setup of prior-art key depression detecting means and the mounting positions of the means for a white key and a black key.

It is supposed that switches $SW_1$–$SW_4$ which are turned "on" by the contacts $RC_1'$, $RC_2'$, $RC_3'$ and $RC_4'$ are arranged as in FIG. 1.

Figure 3:
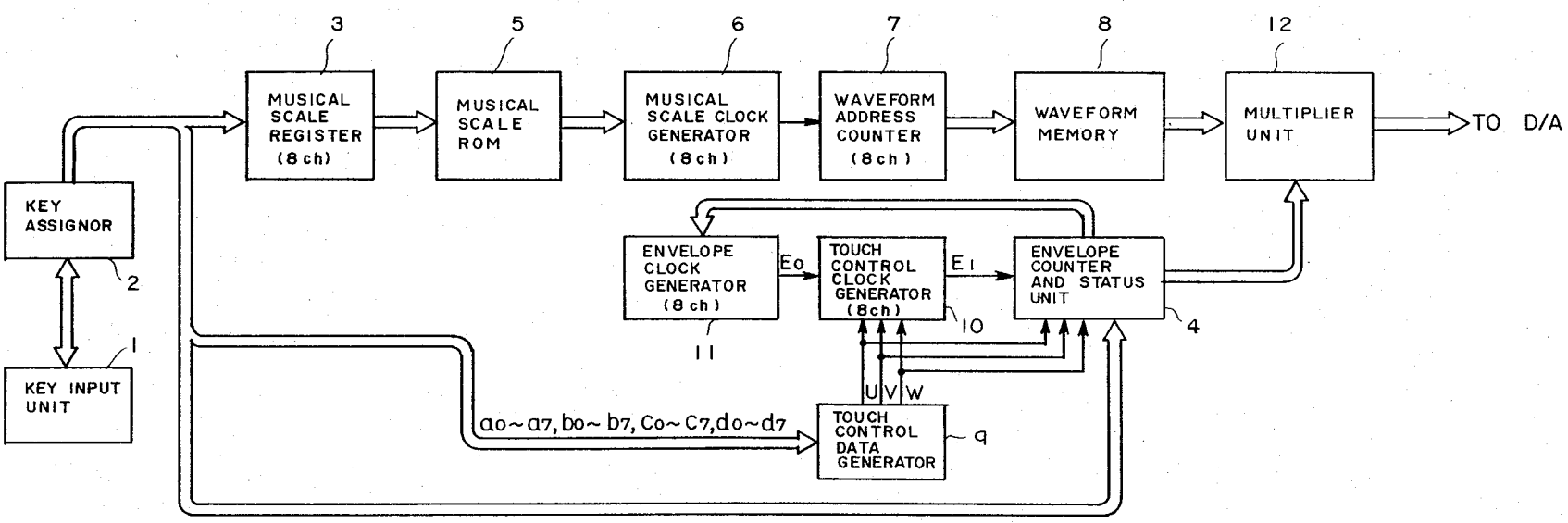
FIG. 3 is a block diagram of the touch response apparatus for an electronic keyboard instrument according to the present invention.
Figure 4A:
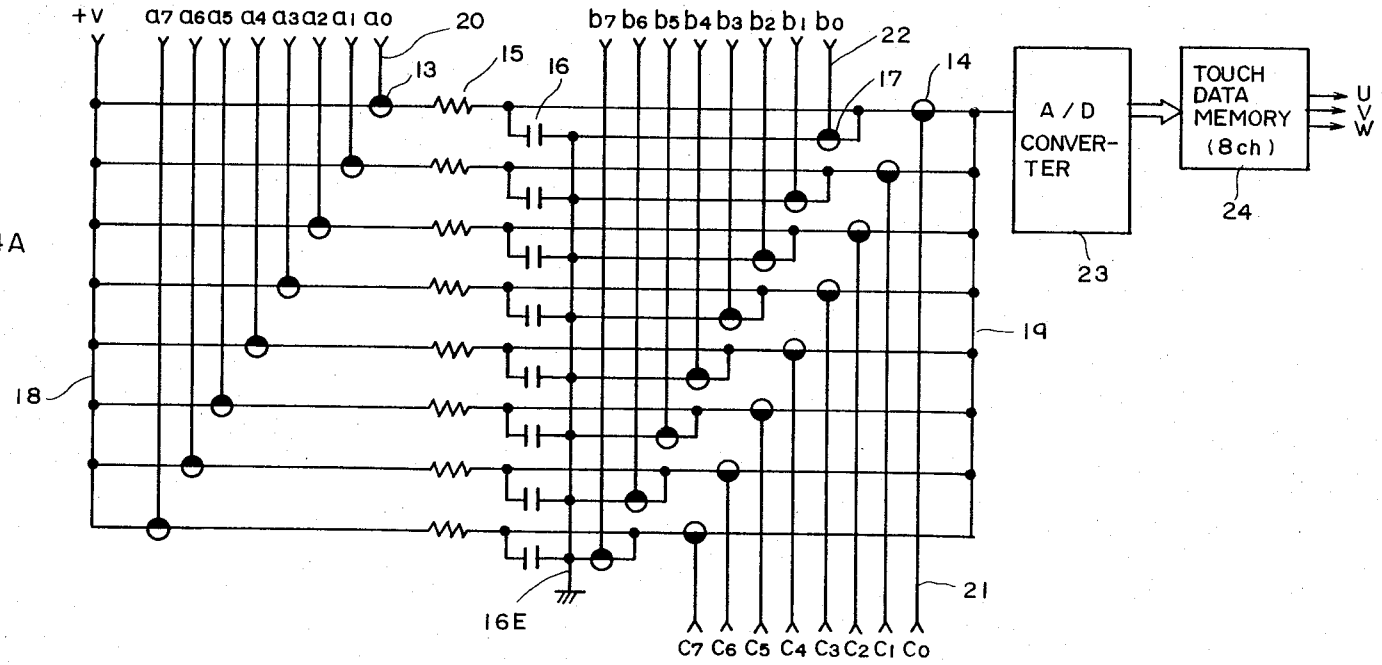
Figure 4B:
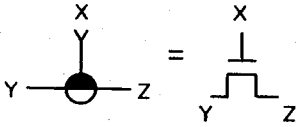
FIG. 4B is a diagram for explaining a symbol in FIG. 4A.

The circuit arrangement of an electronic musical instrument employing such keyboard mechanism is shown in FIG. 3 and FIGS. 4A and 4B.

Referring to FIG. 3, numeral 1 designates a key input unit which consists of a keyboard having a plurality of keys and switches disposed within the keyboard. The switches are as described before, and are constructed and operated as below. Each key is provided with the two contacts $RC_1'$, $RC_2'$ or $RC_3'$, $RC_4'$. The switches are turned "on" with a time difference by one key depressing operation. That is, the switch $SW_1$ or $SW_3$ actuated by the first contact $RC_1'$ or $RC_3'$ is turned "on" earlier, while the switch $SW_2$ or $SW_4$ actuated by the second contact $RC_2'$ or $RC_4'$ is turned "on" later. Each key has the two contacts as stated above, and the switches corresponding to the first and second contacts are arranged at equal intervals on, e.g., a printed circuit board. Therefore, the time differences referred to above do not differ depending upon the keys.

The key depression state of the key input unit 1 is applied to a key assignor 2, the output of which is applied to a musical scale register 3, an envelope counter and status unit 4 and a touch control data generator unit 9.

The scale register 3 is a register in which the codes corresponding to the note and the octave of musical sounds to be generated upon the depression of the keys are stored.

The output of the scale register 3 is applied to a musical-scale read-only memory 5 (hereinbelow, abbreviated to "ROM") to access the address of the scale ROM 5. The scale ROM 5 stores therein clock information corresponding to the respective keys, and the data of the accessed address of the scale ROM 5 is delivered to a musical-scale clock generator unit 6.

The scale clock generator unit 6 produces a scale clock which is to be generated by the data of the scale ROM 5, namely, the clock information corresponding to the key. This scale clock is outputted to a waveform address counter 7.

The waveform address counter 7 counts the clock pulses generated by the scale clock generator 6. The count value increments each time the clock pulse is inputted. That is, the count value increases at a specified speed corresponding to the frequency of a musical scale. The output of the waveform address counter 7 accesses the address of a waveform memory 8.

Data for, e.g., one period of the musical sound to be generated is stored in the waveform memory 8, and said waveform memory 8 is addressed by the waveform address counter 7. The output of the waveform memory 8 is digital data corresponding to the musical sound.

Meanwhile, the touch control data generator unit 9 is supplied with control signals $a_0$–$a_7$, $b_0$–$b_7$, $c_0$–$c_7$ and $d_0$–$d_7$ corresponding to the depressing operations of the key input unit 1.

In the touch control data generator unit 9, digital data of three bits u, v and w are finally produced from an analog voltage which is proportional to the key depression speed.

The digital data u, v and w from the touch control data generator unit 9 are inputted to a touch control clock generator unit 10 and the envelope counter and status unit 4.

The touch control clock generator unit 10 generates a clock $E_1$ corresponding to the key depression speed, on the basis of a clock signal $E_0$ delivered from an envelope clock generator unit 11 and the 3-bit data u, v and w outputted from the touch control data generator unit 9.

The envelope counter and status unit 4 generates envelope data by counting the clock pulses $E_1$.

The output of the envelope counter and status unit 4 is applied to a multiplier unit 12, and also informs the envelope clock generator unit 11 of a status such as attack, decay or release. The envelope clock generator unit 11 is accordingly permitted to provide the envelope clock signal $E_0$ corresponding to the status.

The multiplier unit 12 multiplies the outputs of the envelope counter and status unit 4 and the waveform memory 8, and the resulting product is outputted to a digital-to-analog converter circuit.

The digital data produced by the multiplier unit 12 is the musical sound corresponding to the key, and the amplitude value thereof has a value corresponding to the depression speed. As a matter of course, therefore, the analog signal into which this digital signal is converted by the digital-to-analog converter circuit (not shown in FIG. 3) has the musical scale frequency corresponding to the depressed key, and has the value corresponding to the touch response.

Each of the scale register 3, envelope counter and status unit 4, scale clock generator unit 6, waveform address counter 7, touch control clock generator unit 10 and envelope clock generator unit 11 performs the time-division processing operation of eight channels. By way of example, each of them includes therein a looped shift register of eight stages, and such shift registers hold their contents circulatively so that the synchronous operations of each channel can be executed.

The touch control data generator unit 9 shown in FIG. 3 is illustrated in FIG. 4A. The number of key depression speed detector circuits for use in the present invention is smaller than the number of keys, and is equal to or larger than the maximum number of sounds to be generated. In FIG. 4A, eight key depression speed detector circuits are comprised. A symbol used here corresponds to the gate circuit of a transistor or the like as the general symbol, as indicated in FIG. 4B. Letters X, Y and Z correspond to the gate, drain and source (the base, emitter and collector) of the transistor, respectively. The Z electrode of a first gate circuit 13 is connected in series with that of a second gate circuit 14 through a resistor 15. A series circuit consisting of a capacitor 16 and the Y electrode of a third gate circuit 17 connected in series is connected in parallel between the gate circuit 14 and the resistor 15. The node between the capacitor 16 and the Y electrode of the third gate circuit 17 is grounded at 16E. The first to third gate circuits 13, 14 and 17 have, e.g., the X electrodes, corresponding to the gates of FETs, supplied with the signals $a_0$, $b_0$ and $c_0$ from the key assignor 2 of FIG. 3 via lines 20, 21 and 22, respectively. Such seven key depression speed detector circuits are further constructed similarly. One-side ends of the first group of gate circuits 13 are connected in common as shown at numeral 18, and are supplied with a power source voltage +V. One-side ends of the second group of gate circuits 14 are connected in common as shown at numeral 19. Lines for the signals $a_1$–$a_7$, $b_1$–$b_7$ and $c_1$–$c_7$ are connected to the gate electrodes of the respective gate circuits, to couple them to the key assignor 2. An A/D converter 23 is connected to the second gate circuit output. Data digitally converted exponentially are stored in a touch data memory 24 of eight channels, and the touch control clock generator unit 10, and envelope counter and status unit 4 shown in FIG. 3 are supplied with the 3-bit signals u, v and w.

Figure 5:
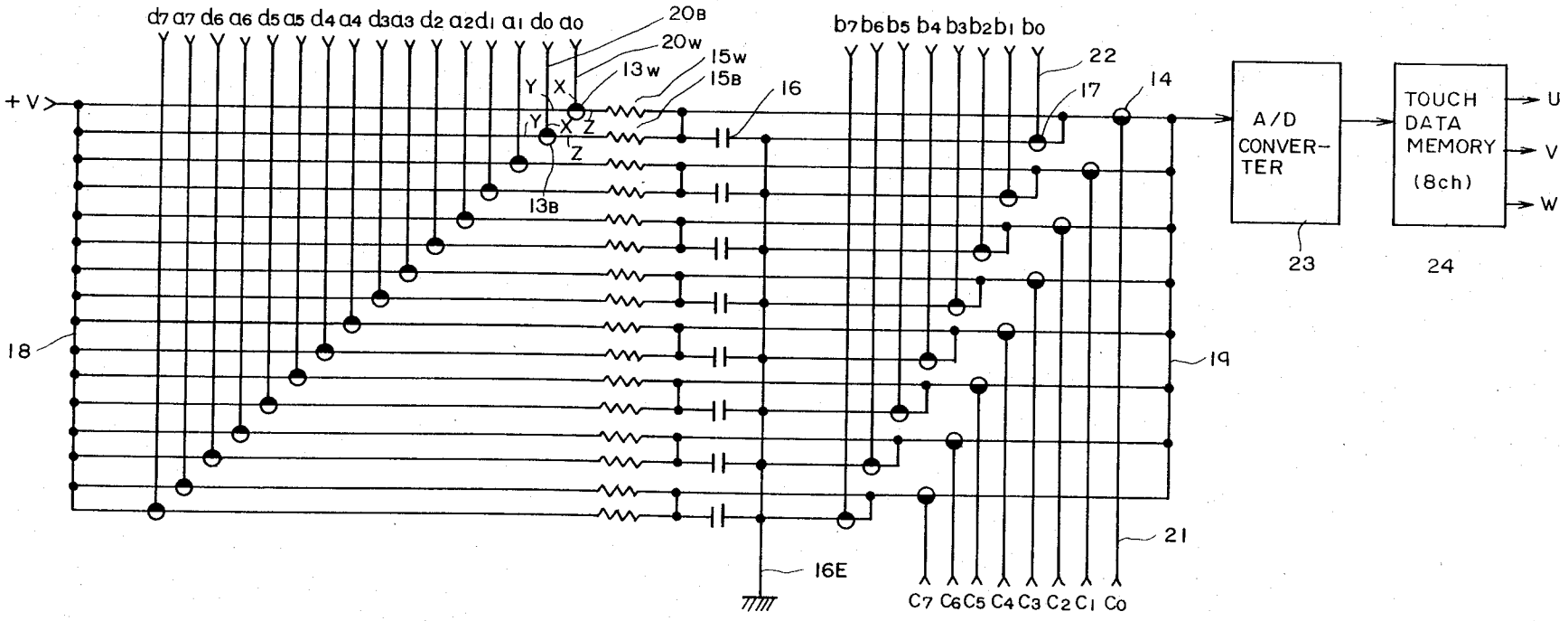
FIG. 5 is a circuit diagram of the touch control data generator unit showing another embodiment of the present invention.
Figure 6:
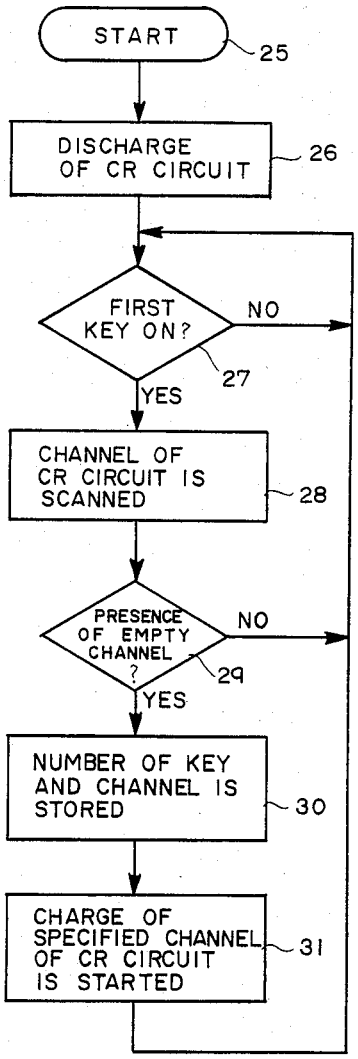
FIGS. 6 and 7 are flow charts for explaining the operations of the embodiment of the touch response apparatus for an electronic keyboard instrument.

FIG. 5 shows a touch control generator unit (9) which is another embodiment of the present invention. The embodiment teaches key depression speed detecting means for electrically compensating the difference of the mounting positions of a white key and a black key. It includes eight gate circuits $13_W$, $13_B$ for each of the white and black keys, and it includes eight compensation resistors $15_B$, $15_W$ for each of white and black keys and eight capacitors 16 at each gate output. The resistances of the resistors $15_W$ and $15_B$ may be set at the ratio of 3:2 when the dimensions of the white key WK and black key BK are set as shown in FIG. 2. For example, the resistor $15_W$ is set at 3 kΩ, and the resistor $15_B$ at 2 kΩ.

The arrangement shown in FIG. 5 will now be explained. The connectional relations between the resistor $15_W$ connected to the Z electrode of the first gate circuit $13_W$ for the white key and the second gate circuit 14, capacitor 16 and third gate circuit 17 are the same as in the arrangement shown in FIG. 4A. Further, one end of the resistor $15_B$ is connected in series with the Z electrode of the first gate circuit $13_B$ for the black key, while the other end thereof is connected to the node between the resistor $15_W$ and the capacitor 16.

Lines $20_W$, $20_B$, 21 and 22 which correspond respectively to the first to third gate circuits $13_W$, $13_B$, 14 and 17 are fed with the signals $a_0$, $d_0$, $b_0$ and $c_0$ from the key assignor 2 in FIG. 3.

Such seven key depression speed detecting means are further constructed similarly. One-side ends of the groups of gate circuits $13_W$ and $13_B$ on which the gate signals are impressed from the white key and black key are connected in common as indicated at numeral 18, and they are fed with a supply voltage +V. Also one-side ends of the second gate circuits 14 are connected in common as indicated at numeral 19. The other-side ends of the group of capacitors 16 are connected in common as indicated at symbol $16_E$ and then grounded.

Lines for the signals $a_0$–$a_7$, $d_0$–$d_7$, $b_0$–$b_7$ and $c_0$–$c_7$ are connected to the gate parts of the respective gate circuits of the first to third groups of gate circuits, to couple them to the key assignor. Since the remaining arrangement is the same as in FIG. 4A, it will not be repeatedly explained.

The operations of the above arrangement will now be described.

When the operation of detecting the depression of a key in a keyboard is started (25 in FIG. 6), the signals $b_0$–$b_7$ are applied to the gates of the third gate circuit 17 from the key assignor 2 in order to render all the capacitors 16 of the key depression speed detection means of FIG. 4A or FIG. 5 idle channels. Thus, charges stored in the capacitors 16 are discharged (26).

Subsequently, when the first contact, e.g., $RC_1'$ (refer to FIG. 2) corresponding to any desired one of the various keys falls into the "on" state (27), the channels of the CR circuits consisting of the group of capacitors 16 and the group of resistors 15 or $15_W$, $15_B$ are scanned (28). In the presence of the empty channel (29 in FIG. 6), the key assignor 2 in FIG. 3 stores the number of the key and the channel n (30 in FIG. 6), and it starts the charging of the specified empty channel of the group of CR circuits shown in FIG. 4A or FIG. 5 (31 in FIG. 6).

By way of example, it is supposed that the channel having the capacitor corresponding to the gate electrode of the first gate circuit 13 or the gate circuit of the white key $13_W$ in FIG. 4A or FIG. 5 is the idle channel. Then, the signal $a_0$ is applied from the key assignor 2 to the gate line 20 or $20_W$ of the gate circuit 13 or $13_W$, to turn "on" the gate circuit. At this time, the second and third gate circuits 14 and 17 are in the "off" states.

Therefore, the capacitor 16 is charged by the power supply +V along the path of the first gate circuit 13 (or $13_W$)-resistor 15-capacitor 16-ground $16_E$.

When the black key BK is depressed in the case of FIG. 5, the X electrode of the gate circuit $13_B$ corresponding to the gate applies the signal $d_0$ to the line $20_B$, to turn "on" this gate circuit $13_B$. At this time, the capacitor 16 is charged by the power supply +V along the path of the first gate circuit $13_B$ for the black key-resistor $15_B$-capacitor 16-ground $16_E$.

Therefore, when the resistances of the resistor $15_W$ for the white key WK and that of the resistor $15_B$ for the black key BK are rendered unequal in correspondence with the different distances of the mounting positions of the contacts as described before, the difference of the mounting positions of the contacts can be electrically compensated.

Next, upon lapse of a certain time, the second contact, e.g., $RC_2'$ of the switch falls into the "on" state.

At this time, the first gate circuit 13 or $13_W$ is brought into the "off" state by the gate signal which is applied thereto by the key assignor 2.

This situation will be explained with reference to a flow chart of FIG. 7.

Under an interruption condition (32 in FIG. 7), in the state in which the second contact $RC_2'$ has turned "on", the capacitor 16 having previously been "on" is sought. That is, the channel of the CR circuit is sought from the number of the key as to which the second contact has turned "on" (33 in FIG. 7). Thus, the first gate circuit 13 is turned "off" in order to stop the charging of the capacitor 16 of the CR circuit (34 in FIG. 7). Subsequently, in order to supply the A/D converter 23 with the charge voltage, or the terminal voltage of the capacitor, of the channel as to which the second contact has turned "on", the gate signal $c_0$ is applied from the key assignor 2 to the gate electrode of the second gate circuit 14 through the gate line 21 so as to turn "on" this second gate circuit. When the A/D conversion has ended and the voltage corresponding to the key depression speed has been stored in the touch data memory 24, the gate circuit 14 turns "off" (35 in FIG. 7).

Figure 7:
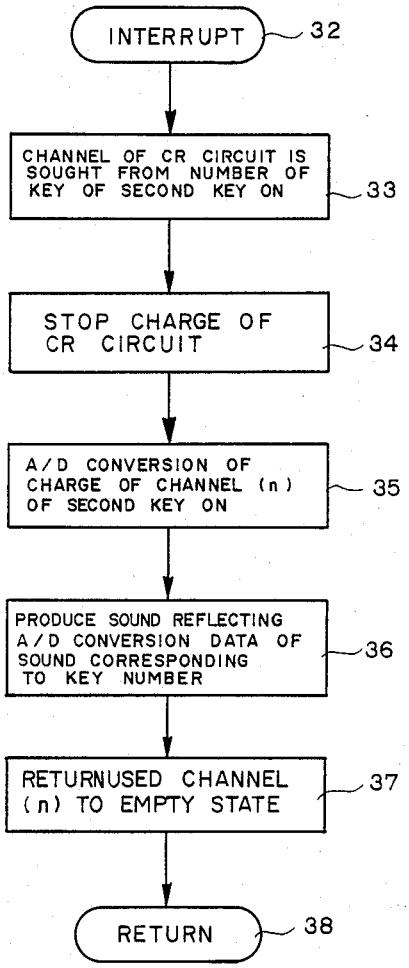

Next, the musical sound conforming with the touch response corresponding to the number of the key is generated (36 in FIG. 7).

Since the output of the A/D converter 23 has been held in any channel of the touch data memory 24, the signal $b_0$ is sent to the third gate circuit 17 via the gate line 22 so as to turn it "on". Thus, the charges of the capacitor 16 are discharged (37 in FIG. 7), and the next step of return (38 in FIG. 7) gets ready for the subsequent detection.

While, in the above embodiment, the capacitor is charged at the point of time of the turn-on of the first contact, it may well be discharged. Further, while in the embodiment the actual channel for generating the sound is allotted when the first contact has fallen into the "on" state, it may well be allotted in the "on" state of the second contact. In this case, touches the number of which is larger than the number of sounds to be generated may be detected, and the channels may be allotted successively in the order of the earlier "on" states of the second contacts.

A plurality of capacitors may be prepared and be switched and used instead of the compensating resistors for white keys and those for black keys.

Further, the compensator circuit is not restricted to the charging and discharging circuit, but it may well be a digital arithmetic circuit, e.g., microcomputer.

While, in the above embodiment, the key touch detector circuit is constructed of the capacitors and resistors, it is not always restricted thereto.

Since the present invention is constructed as described above, each key does not possess the key depression speed detector circuit, and hence, the circuitry does not become complicated. Furthermore, since the key depression speed of each key is detected by the CR circuit, the external control is easy, and since no control current is caused to flow to the switch SW under each key, the deterioration of the keyboard ascribable to contact resistance etc. can be prevented.

Moreover, even in the case where the key depression detection means for the white key and the black key are disposed in different positions so as to establish the natural mechanism, the difference of the mounting positions can be compensated, and hence, similar touch response effects can be afforded for the white key and the black key. Another advantage is that, since the key depression speed detecting means is not disposed for each key, the circuitry does not become complicated.

The above description is given on the preferred embodiment of the invention, but it will be apparent that many modifications and variations could be effected by one skilled in the art without departing from the spirits or scope on the novel concepts of the invention, so that the scope of the invention should not be determined by the appended claims only.

What is claimed is:

1. A touch response apparatus for changing a sound characteristic of an output musical sound from an electronic keyboard musical instrument according to the depression speed of a performance key being operated, comprising:

a keyboard having a plurality of keys, each corresponding to respective different notes;

key depression detection means coupled to said keyboard and including a set of first and second switching means, each of said first and second switching means corresponding to each key of the keyboard and being switched in a predetermined order at the time of the operation of said each key;

key depression speed detection means coupled to said key depression detection means for detecting a depression speed of the key being depressed, and including:

a plurality of charge-and-discharge circuits smaller in number than the number of keys of said keyboard; means for allotting the operated key to one of the plurality of charge-and-discharge circuits not being used, and for starting and stopping charging or discharging of said allotted charge-and-discharge circuits according to the switching operation of said first and second switching means; and means for producing an output signal corresponding to the charge of said allotted charge-and-discharge circuit; and control means coupled to said plurality of charge-and-discharge circuits for controlling a sound characteristic of the output musical sound produced by the instrument as a function of the output signal of the allotted charge-and-discharge circuit.

2. A touch response apparatus as defined in claim 1, wherein said key depression speed detection means comprises compensation means for compensating a difference between a mounting position of said first and second switching means for a white key of said keyboard and that of said first and second switching means for a black key of said keyboard.

3. A touch response apparatus as defined in claim 1, wherein said key depression speed detection means includes charge-and-discharge circuits which have unequal time constants for a white key and a black key of said keyboard.

4. A touch response apparatus for changing a sound characteristic of an output musical sound from an electronic keyboard musical instrument according to the depression speed of a performance key being operated, comprising:

a keyboard having a plurality of keys, each corresponding to respective different notes;

key depression detection means coupled to said keyboard and including a set of first and second switching means, each of said first and second switching means corresponding to each key of the keyboard and being switched in a predetermined order at the time of the operation of said each key;

key depression speed detection means coupled to said key depression detection means for detecting a depression speed of the key being depressed, and including:

a plurality of charge-and-discharge circuits smaller in number than the number of keys of said keyboard; means for allotting the operated key to one of the plurality of charge-and-discharge circuits not being used, and for starting and stopping charging or discharging of said allotted charge-and-discharge circuit according to the switching operation of said first and second switching means; a plurality of first gate circuits; a plurality of resistors; a plurality of second gate circuits, each of which is connected in series with a respective first gate circuit and a respective resistor to form a plurality of first series circuits, each of said first series circuits connected in common at both of their respective ends; means for supplying a power source voltage to one of said ends of said common connection of said first series circuits; an analog-to-digital converter coupled at the other end of said commonly connected first series circuits; a plurality of capacitors; a plurality of third gate circuits connected in series with respective capacitors to form a plurality of second series circuits, said second series circuits being connected in parallel between said resistor and second gate circuits of said first series circuits; means for coupling a node between a plurality of said capacitors and third gate circuits to ground potential, whereby signals for connecting and disconnecting said first and third gate circuits can be allotted; and means for producing an output signal corresponding to the charge of said allotted charge-and-discharge circuit; and control means coupled to said plurality of charge-and-discharge circuits for controlling a sound characteristic of the output musical sound produced by the instrument as a function of the output signal of the allotted charge-and-discharge circuit.

5. A touch response apparatus for changing a sound characteristic of an output musical sound from an electronic keyboard musical instrument according to the depresion speed of a performance key being depressed, comprising:

a keyboard having a plurality of keys, each corresponding to respective different notes;

key depression detection means coupled to said keyboard and including a set of first and second switching means, each of said first and second switching means corresponding to each key of the keyboard and being switched in a predetermined order at the time of the depression of said each key;

a plurality of depression speed detection means coupled to said key depression detection means for measuring depression speeds of depressed keys according to the switching time difference of the first and second switching means corresponding to the depressed keys;

allotment means coupled to said depression detection means and to said plurality of depression speed detection means for allotting a depressed key to one of said plurality of depression speed detection means not in use;

each of said plurality of depression speed detection means including means for compensating difference between a mounting position of said first and second switching means for a white key and that of said first and second switching means for a black key; and control means coupled to said plurality of depression speed detection means for controlling the sound characteristic of an output musical sound produced by the electronic musical instrument as a function of the output signal of the allotted depression speed detection means.

6. A touch response apparatus as defined in claim 5, wherein each of said depression speed detection means includes charge-and-discharge circuits which are provided with resistors of unequal resistances or capacitors of unequal capacitances in correspondence with a white key and a black key of said keyboard.

7. A touch response apparatus as defined in claim 6, wherein distances of the mounting position of said first and second switching means from a fulcrum of said white key and that of said first and second switching means from a fulcrum of said black key are set equal to a proportion of a characteristic value of said charge-and-discharge circuits disposed in correspondence with said white key and said black key.

8. A touch response apparatus for an electronic keyboard instrument, comprising:

a keyboard having a plurality of keys, each corresponding to a respective different note;

key depression detection means coupled to said keyboard for detecting a depression of a key, and including a set of switches corresponding to said plurality of keys, each of said switches having a plurality of contacts which are switched in a predetermined order at the time of the depression of the key;

tone generating means coupled to said key depression detection means for generating a plurality of musical tones simultaneously according to the depression of said plurality of keys of said keyboard;

a plurality of key depression speed detection means substantially the same in number as the number of the tones which can be generated simultaneously by said tone generating means, and smaller in number than the number of keys of said keyboard, for detecting the key depression speed according to the switching time difference of said plurality of contacts of said switches, and for generating a corresponding output signal;

allotment means for allotting the depressed key to one of said key depression speed detection means not in use; and control means coupled to said tone generating means and to said plurality of key depression speed detection means for controlling a sound characteristic of the tones to be generated by said tone generating means in accordance with the output signal of the allotted key depression speed detection means.

9. A touch response apparatus as defined in claim 8, wherein each of said key depression speed detection means includes a charge-and-discharge circuit.

10. A touch response apparatus as defined in claim 8, wherein each of said key depression speed detection means includes compensation means for compensating a difference between a mounting position of said switch for a white key of said keyboard and that of said switch for a black key of said keyboard.

11. A touch response apparatus as defined in claim 8, wherein said control means includes envelope control means for controlling the envelope of the tones according to the output signal of said allotted depression speed detection means.

12. An electronic keyboard musical instrument having a touch response function, comprising:

a keyboard having a plurality of performance keys;

a set of switching means provided for each performance key, each switching means including at least two contacts which are operated in a predetermined order when a corresponding performance key is depressed;

tone generating means coupled to said keyboard for generating a plurality of musical tones simultaneously according to the depression of the performance keys;

key depression state detecting means coupled to said set of switching means, and including:

a plurality of detection devices substantially the same in number as the number of tones which can be generated from said tone generating means simultaneously, and smaller in number than the number of performance keys of said keyboard, for detecting the key depression state in accordance with the operation time difference of said at least two contacts; means for allotting the depressed key to one of said detection devices not in use; and storing means coupled to said plurality of detection devices for storing a plurality of touch data generated by said plurality of detection devices; and control means coupled to said key depression state detecting means and to said tone generating means, for supplying the touch data stored in said storing means for said tone generating means to generate tones having individual characteristics determined by said touch data.

13. An electronic keyboard musical instrument as defined in claim 12, wherein said tone generating means generates tones having envelopes determined by the touch data supplied by said control means.

14. An electronic keyboard musical instrument as defined in claim 12, wherein each of said detection devices includes a charge-and-discharge circuit, each producing an output voltage signal; said key depression state detecting means includes means for starting and stopping charging or discharging of said charge-and-discharge circuit according to the operation of said at least two contacts; and analog-to-digital converter means for converting the output voltage signal of said charge-and-discharge circuit to the touch data.

* * * * *